US006457950B1

(12) United States Patent
Cooper et al.

(10) Patent No.: US 6,457,950 B1
(45) Date of Patent: Oct. 1, 2002

(54) SEALLESS MULTIPHASE SCREW-PUMP-AND-MOTOR PACKAGE

(75) Inventors: Paul Cooper, Titusville, NJ (US); Allan J. Prang, Brantford (CA)

(73) Assignee: Flowserve Management Company, Irving, TX (US)

( * ) Notice: Subject to any disclaimer, the term of this patent is extended or adjusted under 35 U.S.C. 154(b) by 0 days.

(21) Appl. No.: 09/564,274

(22) Filed: May 4, 2000

(51) Int. Cl.[7] ..... F04B 17/00
(52) U.S. Cl. ..... 417/366; 418/102
(58) Field of Search ..... 417/366, 361, 417/370, 410.1; 418/102

(56) References Cited

U.S. PATENT DOCUMENTS

| | | | | |
|---|---|---|---|---|
| 3,975,123 | A | 8/1976 | Schibbye | 418/97 |
| 4,038,000 | A | 7/1977 | Dworak | 418/102 |
| 4,375,156 | A | 3/1983 | Shaw | 62/468 |
| 4,484,868 | A | 11/1984 | Shibuya et al. | 418/15 |
| 4,547,135 | A | 10/1985 | Noel et al. | 417/360 |
| 4,940,401 | A | 7/1990 | White, Jr. | 418/61.3 |
| 5,083,909 | A | 1/1992 | Kunsemille et al. | 418/102 |
| 5,167,496 | A | 12/1992 | Jacobsson et al. | 418/102 |
| 5,197,869 | A | 3/1993 | Hansen et al. | 418/77 |
| 5,259,741 | A | 11/1993 | Nitta | 418/102 |
| 5,591,016 | A | 1/1997 | Kubota et al. | 417/365 |
| 5,624,243 | A | 4/1997 | Omodaka et al. | 417/366 |
| 5,624,249 | A | 4/1997 | Rohlfing | 418/102 |
| 5,641,281 | A | 6/1997 | Russell et al. | 418/102 |

OTHER PUBLICATIONS

Cooper et al (OTC 8861), "A Versatile Multiphase Two-Screw Pump Package for Subsea Deployment", Houston, Texas May 4–7, 1998.*

Cooper, P., et al. "A Versatile Multiphase Two–Screw Pump Package for Subsea Deployment," Copyright 1998, Offshore Technology Conf. OTC 8861.

Cooper, P., et al. "Applying Multiphase Screw Pumps Subsea", Seventh European Congress on Fluid Machinery for the Oil, Petrochemical and Related Industries, Apr. 15–16, 1999, The Hague, Netherlands.

* cited by examiner

*Primary Examiner*—Charles G. Freay
*Assistant Examiner*—William Rodriguez
(74) *Attorney, Agent, or Firm*—Killworth, Gottman, Hagan & Schaeff, L.L.P.

(57) ABSTRACT

A pump is disclosed, including a motor and a pump housing, for pumping mixed gas and liquid. The pump includes two intermeshed screw members for providing progressive cavities for transporting mixed fluids, within a pumping cavity, from a suction passage to a discharge reservoir of the pump housing. It further uses pumped product to provide cooling and lubrication to the motor and to bearings and timing gears of the screw members. By using pumped product for lubrication and cooling, the need for seals is eliminated, thereby reducing the need for maintenance. This makes the pump package advantageous for subsea deployment for use in pumping nearly depleted wells which may be manifolded together to provide adequate product flow.

9 Claims, 3 Drawing Sheets

Performance of Multiphase Screw Pump. Notice small difference in shaft power (BHP) between gas and liquid operation. At 100% gas, none of it leaks back to the pump inlet. Data are for MP1-125.

SEALLESS MULTIPHASE SCREW-PUMP-AND-MOTOR PACKAGE

CROSS REFERENCE TO RELATED APPLICATIONS

This application claims priority from Provisional U.S. Patent Application Serial No. 60/132,450, filed on May 4, 1999 by the inventors herein and assigned to the assignee hereof.

BACKGROUND OF THE INVENTION

This invention relates generally to positive displacement pumps and more particularly to sealless screw pump/motor packages especially for pumping multi-phase fluids in subsea applications.

As remote subsea wells deplete, boosting is not cost effective if the pump requires mostly liquid in order to function; because such wells produce a large volume fraction of dirty water and gas along with a small amount of oil. The small amounts of oil involved, 1000 barrels per day (bpd) or less, cannot be economically recovered unless a multiphase pump is located in the vicinity of the well. To improve economics, multiple wells can be manifolded together to feed a single pump, the piping arrangement providing for a flow check of each pump individually. This concept is illustrated in FIG. 1. Several of such multiphase pumps delivering product to centrally located separation equipment on a surface platform or onshore appears to be a practical way to extend the life of wells that would otherwise have to be abandoned. These wells normally produce mixtures of gas, oil and water in varying proportions that can vary considerably at the pump inlet over time. Gas void fractions (GVF) of 0.95 (i.e., 95% gas by volume)—and higher—are fairly typical. GVF is related to the more frequently quoted gas-oil ratio (GOR) or the mass of gas in standard cubic feet per barrel of oil (scf/bbl) as follows:

$$GVF=GLR/(1+GLR) \tag{1}$$

where GLR is the volume flowrate ratio of gas $Q_G$ to liquid $Q_L$ and is given by $$GLR=(GOR)(T/T_{std})(P_{std}/P)/(5.615 \text{ cu ft per bbl}) \tag{2}$$

where T is absolute temperature and p is pressure. Standard temperature and pressure are 15° C. and 14.7 psia respectively; so that $T_{std}$=(273.15+15)°K. This mixture must be pumped to as much as 50 bar or 700 psi.

To date, practically all multiphase pumps have been located on the surface and generally onshore, where the installation costs are smaller and the frequent maintenance needed for new concepts can be carried out with relative ease. To install and maintain a pump subsea requires a considerable infusion of deepwater technology, which is as sophisticated as the design of the pump package itself. As more success is achieved in dealing with the technical and reliability issues encountered in the multiphase pumps located on the surface, there is now more impetus to place them subsea.

For pumping multiphase fluids, two quite different types of multiphase pump are employed, namely, a) rotodynamic and b) rotary positive displacement. Type (a) creates pressure dynamically; i.e., shaft torque is converted into fluid angular momentum. The pressure rise then depends on the product of average fluid density and velocity change. The helico-axial configuration is the rotodynamic concept that is used for multiphase pumping, because it has many axial-flow stages that do not vapor-lock; i.e., they do not separate the gas and liquid phases by the centrifuging—as can occur, e.g., in a single-stage centrifugal pump (also a rotodynamic machine). This machine depends on speed and fluid density to develop pressure. Sudden changes in fluid density, as would occur in slugging, produce sudden changes in torque. Type (b) develops pressure hydrostatically and so does not depend on the pump speed or fluid density. The inlet of the pump is walled off from the discharge, e.g. in the case of the popular two-screw configuration, by the meshing of the screws. As with a reciprocating pump, the shaft power is simply the displacement volume rate $Q_d$ times the pressure difference $\Delta p$ across the pump; and the shaft torque is this power divided by the angular speed $\omega$ of the drive shaft. Thus if slugging occurs and the $\Delta p$ remains constant, this slugging has a relatively small effect on shaft torque.

In both cases, the intake volume flowrate capability increases with speed. A rotodynamic pump needs to speed up at high GVF (low average fluid density) in order to maintain $\Delta p$ at the same level that a lower speed produces at lower GVF; while a positive displacement pump can run at constant speed; albeit with reduced liquid output.

The efficiency of multistage pumping is the ideal power $P_i$ divided by the pump shaft power $P_s$. In the presence of typical amounts of liquid, the process tends to be isothermal, in which case $P_i=P_{isoth}$, where $$P_{isoth}=mRT_1 1n(p_2/p_1)+Q_L\Delta p \tag{3}$$

whereas, for no liquid flow $Q_L$ present, the process tends to be adiabatic, in which case $P_i=P_{ad}$, where $$P_{ad}=mc_pJT_1\{[p_2/p_1]\exp[\gamma-1)/\gamma]-1\} \tag{4}$$

In these equations, m is the mass flowrate, R is the gas constant, $c_p$ is the specific heat of the gas at constant pressure, J is the mechanical equivalent of heat, $\gamma$ is the ratio of specific heats of the gas, and subscripts 1 and 2 denote pump inlet and discharge respectively.

Multistaging minimizes the shaft power for a given ideal power, especially for high pressure ratios $p_2/p_1$. Such multistaging is necessary for helico-axial pumps to work; however, a single stage is the normal embodiment of a screw pump. Screw pumps tend to be smaller; so that efficiency may not then be an issue. In view of this, screw pumps are preferable for subsea applications because the small sizes needed for the low flowing remote wells are relatively inexpensive. Further economies are to be had in that they can be driven subsea by correspondingly small, constant-speed, submersible electric motors; thereby eliminating the need for VFD's or subsea deployment of hydraulic lines to run variable-speed turbines. Also, torque shock does not occur with slugging, thereby simplifying the mechanical design of the rotors.

The mechanical design of a two-screw pump is relatively simple, because a double-suction configuration is utilized. Each rotor ingests the fluid from both ends and conveys it to the center, where it is discharged, providing an axial balance that insures long bearing life. The screws do not touch each other, and clearance is provided between the screws and the surrounding bores in the body. The two rotors are kept clear of each other by a set of timing gears that are lubricated by clean oil, along with the adjacent bearings, seals being required to isolate this oil from the pumpage. The total diametral clearances and those between the meshing screw threads do not vary with axial position; so, when pumping 100% liquid, the leakage across each land and through each portion of the mesh is the same and produces a linear development of pressure vs. axial length.

Multiphase pumps depend on the liquid sealing of these clearances to produce a net positive flowrate vs. what would otherwise be a massive leakage from discharge back to inlet. In the case of 100% gas (GVF=1), this liquid sealing is maintained by recirculating liquid that was previously captured by a phase-separation plate in the discharge zone at the center of the rotors. The reservoir for this captured liquid is the special feature of a multiphase screw pump that makes possible sustained operation at GVF=1 and which can be seen in FIG. 2. In fact, the liquid sealing is so effective at high GVF that no gas leaks back to the inlet or suction cavities at the ends of the screws. This is illustrated in the laboratory test data of FIG. 3 for the total intake volume flowrate $Q_1$ vs. the pressure difference $\Delta p$ across the pump. Except for the very small leakage of sealing liquid, usually less than 1% of $Q_1$, the volumetric efficiency $\eta_v$, where $\eta_v = Q_1/Q_d$, is therefore 100%.

The development of pressure along the screws at high GVF is not linear with axial position as it would be for pure liquid (GVF=0). This is because gas leaks (along with the sealing liquid) across the higher-pressure screw lands near the center of the pump in order to compress the gas in the neighboring. "lock" or trapped volume between successive mesh points along the length. The pressure drop across the last one or more lands at each of the outer, low-pressure ends of the rotors, is quite small—just enough to maintain a liquid seal, so that the gas doesn't blow back to the pump inlet. So, the pressure develops slowly at the inlet ends of the screws and more rapidly closer to the center (the pump discharge). The number of locks must therefore be sufficient to prevent blow-back. Analysis of this two-phase leakage across the lands shows that the number of locks must increase with pump $\Delta p$, rotor diameter, internal clearance, and decreasing sealing leakage. (There is one more land than the number of locks.) The resulting axial pressure distribution produces a radial load on the screw rotors, which is a consequence of the helical screw pitch. Screw pitch is defined by the specific pumping requirements and takes into account the $\Delta p$, viscosity, and required flowrate. The higher the pitch for a given diameter—or the higher the helix angle, the greater the load. One way to reduce this load is to reverse the direction of flow in the screws so that the fluid enters at the center and flows outward to the discharge, which is now at the ends of the screws and puts discharge pressure on the adjacent seal faces. Finite-element stress analysis reveals that, unfortunately, only a small reduction in radial displacement can be realized by this reversal of flow direction. A stronger rotor is perhaps the best approach, as pressure is kept off the seals and the rotor is more robust.

Consideration of all these factors allows the development of a full range of multiphase two-screw pumps, some having quite high flowrates, as shown in Table 1.

TABLE 1

| IDP | MULTIPHASE SCREW PUMP COVERAGE (barrels per day*) | | | | |
|---|---|---|---|---|---|
| | DIFFERENTIAL PRESSURE (bar) | | | | |
| Model | 10 | 20 | 30 | 40 | 50 |
| MP1-075 | 2551 | 2520 | 1995 | 1495 | 1225 |
| MP1-125 | 11775 | 11640 | 11500 | 9330 | 7865 |
| MP1-150 | 23880 | 23535 | 23170 | 17660 | 15385 |
| MP1-180 | 39175 | 38705 | 36775 | 27075 | 24440 |
| MP1-230 | 65110 | 64445 | 61500 | 49650 | 40245 |

TABLE 1-continued

| IDP | MULTIPHASE SCREW PUMP COVERAGE (barrels per day*) | | | | |
|---|---|---|---|---|---|
| | DIFFERENTIAL PRESSURE (bar) | | | | |
| Model | 10 | 20 | 30 | 40 | 50 |
| MP1-300 | 151210 | 150110 | 144900 | 112690 | 94375 |
| MP1-380 | 191170 | 189085 | 183110 | 146455 | 122020 |

Capacities shown are for GVF of 0.90 with liquid viscosity of 10 cp and are approximate for general sizing purposes. Specific performance data are calculated for each application for the pump size and screw pitch.

Divide by 6.3 to get $m^3/d$

Displacement volume rate $Q_d$ is a function of the screw rotor tip diameter D, typical values of which are found from $$D = K(Q_d/N)^{1/3} \tag{5}$$

where K ranges from 4 to 7, depending on $\Delta p$. D is in inches, $Q_d$ in $m^3$/day, and rotative speed N in rpm.

For subsea applications, the screw pumps described herein are configured with submersible motors for integration of pump and motor into a viable subsea package. These may be three-phase squirrel cage wet motors with power levels ranging from 1 to 5000 kW and speeds from 200 to 3500 rpm—at voltages up to 10,000 V. Besides standard applications, such motors have been used for special applications in offshore, cavern, and subsea environments.

There are three basic configurations of submersible motors for subsea applications; namely, a) standard, water-filled motor, b) oil-filled motor, and c) canned motor.

Water-filled motors are widely used in submersible applications. The liquid is either water or water/glycol, which both lubricates the bearings and cools the motor. Cooling is very effective, so that additional cooling devices are not needed. The winding wire used is insulated with PVC or PE, which tightens against the high pressure. These motors have high reliability and durability.

Oil-filled motors have the same high reliability as do the above water-filled motors but are somewhat larger. A special oil-protected wire is used for the windings. An oil-filled motor is preferred for the subsea multiphase applications discussed herein. It is close-coupled to the pump, so that the oil also lubricates the timing gears and inboard bearing of the pump. A pressure compensating system maintains the oil pressure at a pressure slightly greater than that of the pump suction. Therefore, the motor case must have sufficiently thick walls to withstand well shut-in pressures (up to 350 bar). Adequate cooling can be had to the surrounding seawater by the provision of fins or coils, as needed, to facilitate the needed heat transfer.

Canned motors are used where the liquid would be corrosive to the windings and/or injurious to the insulation. They have a very thin covering of sheet metal (the can) between the stator and the rotor. The stator is filled with a special resin material for insulation, and this material requires special provisions for cooling. The thin can makes these motors vulnerable to the passage of foreign particles between the rotor and stator.

These submersible motors have been used since the late sixties in dredging and offshore working vehicles. They are driving hydraulic power packs, dredge pumps, tracking wheels, elevators, cutters, etc. The subsea vehicles are controlled through an umbilical from a support vessel on the surface. Speed control is possible by varying the speed of motor-generator sets on board the support barge. Subsea application has resulted in only minor changes to the basic design of these submersible motors. A recent example is a trenching system, which includes five 220 kW submersible motors at 60 Hz and 6600 V.

A number of rotary two screw pumps have been used in applications involving multiphase products over the last 30 years. Multiphase screw pumps have been used in the chemical processing, pulp and paper and petrochemical industries. In the last decade, the multiphase pumping applications have concentrated on petroleum products, specifically oil wells. The majority of these applications are surface located and generally onshore. One such application is located in a remote area of Alberta, in western Canada. This relatively small multiphase screw pump is connected to a field of approximately 50 small oil wells. The pump was designed to operate at a GVF of 0.663. This and the other design conditions of service are given in Table 2 and provide for ingestion of 983 $m^3$/day of gas together with a total liquid capacity of 500 $m^3$/day or 3145 bpd—at a pressure rise of 300 psi (21 bar).

TABLE 2

MULTIPHASE SCREW PUMP APPLICATION IN WESTERN CANADA IDP Model MP1-125

| | |
|---|---|
| **Design Conditions of Service** | |
| Discharge Pressure | 375 psig |
| Liquid Capacity | 500 $m^3$/d |
| Inlet Pressure | 75 psig |
| 85% oil | 425 $m^3$/d |
| 15% water | 75 $m^3$/d |
| GOR at std. temp. & pressure | 14.1 |
| Total Inlet Volume | 1483 $m^3$/d |
| GVF at Inlet | 0.663 |
| **Actual Operating Conditions** | |
| Differential Pressure | 200 psi |
| GVF at Inlet | 0.75–0.90 |

The pump is equipped with a special cast body with an integral liquid separating chamber. As the multiphase mixture exits the screw area it must pass though the separating chamber where the fluid velocity is reduced, thus allowing the liquid component to separate from the gas and settle into a chamber under the screw bores. The liquid is then recirculated through cyclone separators and fed back to the inlet areas by way of the mechanical seals. This provides cooling and lubricating liquid for the seals as well as sealing liquid for the pumping screws and allows the pump to operate at GVF values of 1 (i.e., 100% gas) for extended time periods, as long as there is some recirculating liquid available to provide the sealing and cooling,required.

The pump is installed downstream of the free water knockout tank and the speed is controlled to reduce the pressure in this tank from the original 200 PSIG to 40–50 PSIG. With the present wells, this is accomplished with the pump operating at only 60–90% of full speed. The actual GVF of the product varies from 0.75 to 0.90. The benefits are listed in Table 3 and include an 8% increase in oil production with no increase in power draw and a reduction in the system pressure upstream of the pump.

TABLE 3—BENEFITS OF MULTIPHASE SCREW PUMP INSTALLATION MP1-125 Pump-Western Canada No increase in power required
Reduction in well head and system pressure
Reduced differential pressure on downhole progressive cavity pumps
Reduced maintenance of downhole PC pumps: estimated two times service life
Well production capacity increased by 8%
Greatly reduced system maintenance costs Another significant benefit is a greatly increased maintenance life of the downhole progressive cavity pumps. The reduced differential pressure on these small pumps has significantly reduced the wear and they are experiencing approximately 2 times the normal life for such pumps. This has significantly reduced the maintenance costs involved with pulling the pumps from the wells when service is required.

This field experience has confirmed that the weakest area of this multiphase pump is the mechanical seals. The modified flushing system ensures there is a source of clean flush available to cool and lubricate the seals without requiring an external flush system. This makes the pump suitable for remote locations where no separate flush system is available.

The subsea version of the multiphase screw pump has a number of design changes to allow submerged operation at high ambient pressures. FIG. 6 shows an MP1-150 size screw pump connected to a submersible liquid cooled motor. As indicated in Table 4, the unit is sized to ingest 2932 $m^3$/d (18,440 bpd) of liquid and gas and to increase the pressure by 30 bar.

TABLE 4

MP1-150 SUBSEA PROTOTYPE MULTIPHASE SCREW PUMP

| | |
|---|---|
| Screw diameter | 6" |
| Screw pitch | 2" |
| Number of screw locks | 4.5 |
| Operating speed | 1780 RPM |
| Integral hard tipped screws | |
| Chrome plated bores in replaceable liner | |
| Fabricated high pressure body shell | |
| with integral separation chamber | |
| Semi external bearing arrangement | |
| Optional sealless design | |
| **Performance at 0.95 GVF and 425 psi pressure rise** | |
| Capacity | 18440 bpd |
| Power required | 150 HP |

At a nominal GVF of 0.95, the unit consumes 150 hp. This power level increases to 177 hp when pumping 200 cp liquid. The design incorporates a high-pressure fabricated screw pump body with a replaceable cast liner. This design provides an integral liquid separator, which separates the liquid and provides a reservoir at the lower area of the body to store the separated liquid. This separated liquid is recirculated back into the suction areas of the screws to provide the required sealing liquid at very high GVF's.

The cast liner portion of the body contains the precision ground bores where the screws operate with controlled clearances. The drawing shows. O-ring type sealing joints between the liner and the body, which are suitable for pressures up to approximately 2000 psi. For applications above this pressure, different gasketted joint designs are possible to permit this pump to handle high differential static pressures, which could be encountered in a deep subsea application.

This design utilizes two mechanical seals at the inboard end of the pump to seal the product from the lube oil cavity. The seals operate in the lube oil, which provides lubrication and cooling. The front mounted timing gears and thrust bearings are also mounted in the same lube oil chamber which is also connected to the submersible oil filled motor. The wall sections and sealing joints are presently designed for the 2000 psi operating pressure but can be redesigned to handle higher pressures for deeper well applications.

A differential pressure compensator is connected between the pump inlet and the lube oil chamber to control the differential operating pressure on the mechanical seals. The differential pressure compensator shown, utilizes an internal piston mechanism to regulate the differential pressure across the seals to 10% of the pump suction pressure. Other types of pressure compensators can also be used to maintain a constant differential pressure across the seals. The compensator also provides a reservoir of lube oil to make up for minor seal leakage. The sizing and type of compensator are dependent on the seal design and operating conditions and would be sized to provide adequate seal life in subsea applications.

The line bearings at the outboard end of the pump are designed as product-lubricated sleeve bearings. These silicon carbide bearings are capable of supporting the shaft loads and operating in the liquid available. A separate flush porting arrangement, not shown will direct the separated liquid in the reservoir to the ends of these bearings to provide suitable lubrication.

Temperature monitors can be installed to shut down the pump in conditions of high seal or bearing temperatures. This elevated temperature condition would occur only if a slug of 100% gas, of significant duration, were pumped. At GVF=1, the recirculated liquid will eventually dissipate with the gas and insufficient cooling will be available for the bearings. Similarly, if the lube oil supply is lost, high seal temperature will provide a warning for shutdown prior to failure. The pump can be readily restarted when some cooling liquid is available from the product.

The foregoing illustrates limitations known to exist in present subsea multiphase pumps. Thus, it would clearly be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a pump, including a motor and a pump housing, for pumping mixed gas and liquid, said pump comprising two intermeshed screw members for providing progressive cavities for transporting mixed fluids, within a pumping cavity, from a suction passage to a discharge reservoir of the pump housing; and means for providing cooling and lubrication to the motor and to bearings and timing gears of the screw members.

The foregoing and other aspects will become apparent from the following detailed description of the invention when considered in conjunction with the accompanying drawings.

DETAILED DESCRIPTION

Figure 1:
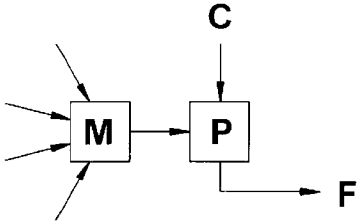
FIG. 1 shows a schematic view of an undersea multiphase pump package connected to a manifold combining flows from a plurality of petroleum wells.

FIG. 1 illustrates the subsea installation ideally used for pumping depleted oil wells. It includes a manifold M or tree, into which the feeds of several depleted wells are gathered. The manifold M is connected to a pumping package P which is connected by a control umbilical C to a surface facility, which may be a,platform or an onshore installation. The pumped product is delivered from the pump P to the surface facility through a flowline F.

Figure 2:
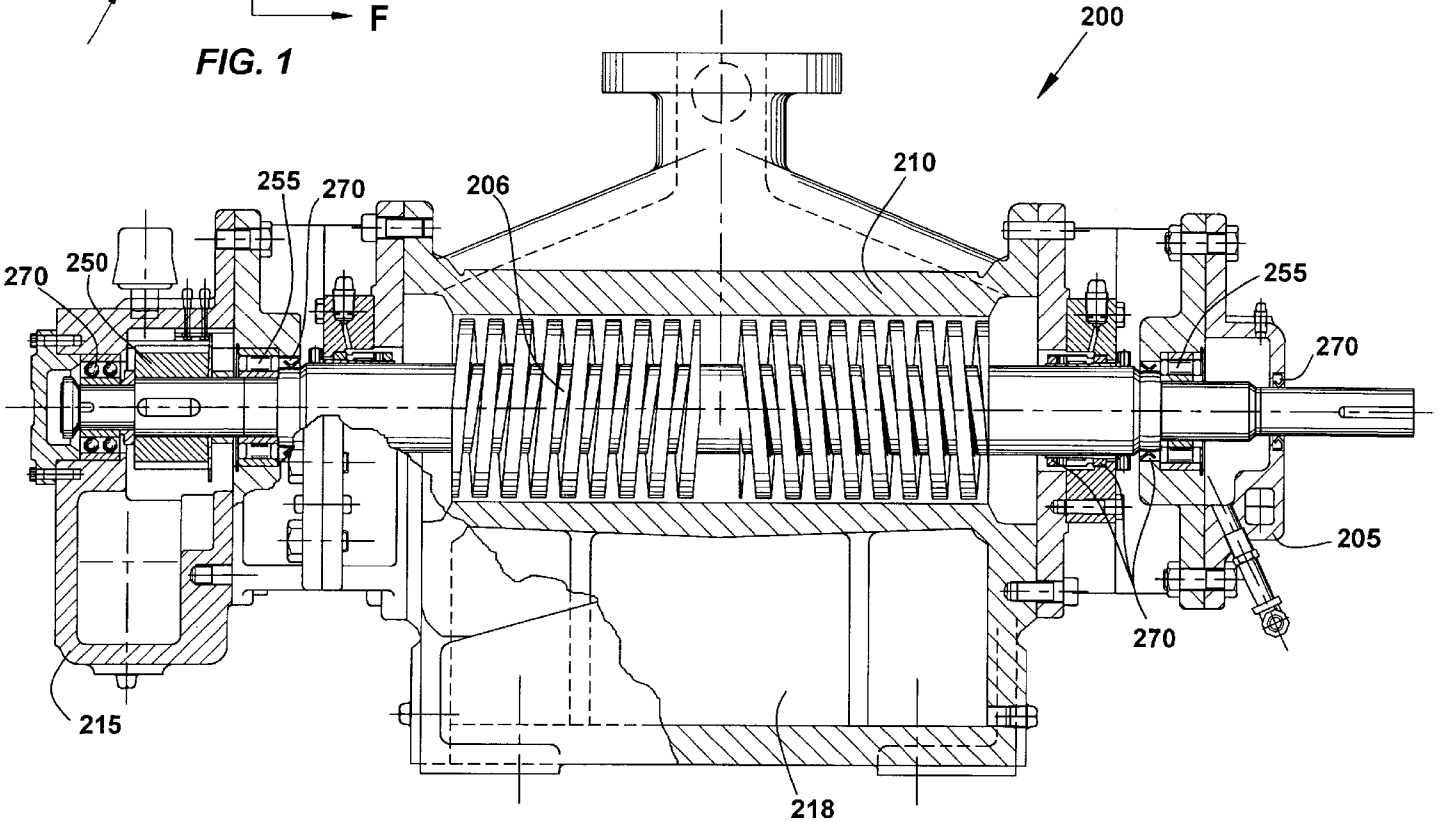
FIG. 2 (PRIOR ART)
FIG. 2 shows a schematic sectional view of a screw pump of the prior art.

FIG. 2 shows a multiphase two-screw pump 200 of the prior art. It consists of a pump housing 210 with a pumping chamber in which two intermeshed screws 206 are disposed to transport fluids from a suction port into a discharge fluid reservoir and, ultimately, out through a discharge passage.

A liquid sump 218 receives a small amount of discharge liquid which is returned to the suction ports during periods when the gas volume fraction approaches 1 and which provides liquid seals between the screw flights during such times. The screws 206 are supported in bearings 255 mounted in the drive housing 205 and the timing housing 215. The bearings 255 and timing gears 250 are typically cooled and lubricated by oil or water/glycol mix. The pumped fluid and the surrounding sea water are excluded from the drive housing 205 and the timing housing 215 by seals 270 to protect the bearings 255 and timing gears 250 from their abrasive and corrosive effects.

Figure 3:
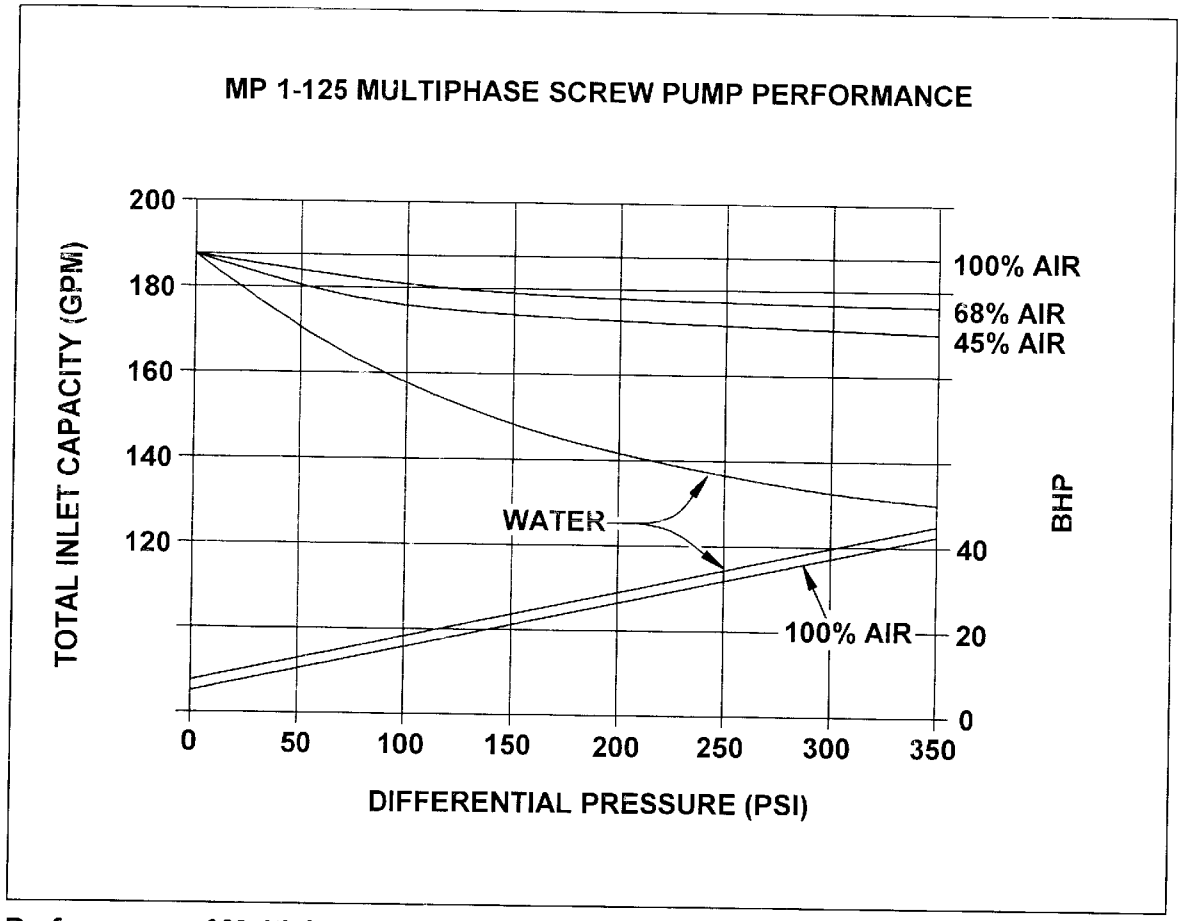
FIG. 3 shows a graph of pump capacity as a function of differential pressure and Gas Volume Fraction; and, FIGS. 4*a* and 4*b* show longitudinal and transverse partially sectional views of a sealless screw pump according to the invention.

FIG. 3 graphically illustrates the pumping performance of multi-phase screw pumps at a variety of pressures and gas void fractions GVF. The minimal difference between shaft power at 0% and 100% GVF is one great advantage of the screw pump over other pump designs.

Figure 4A:
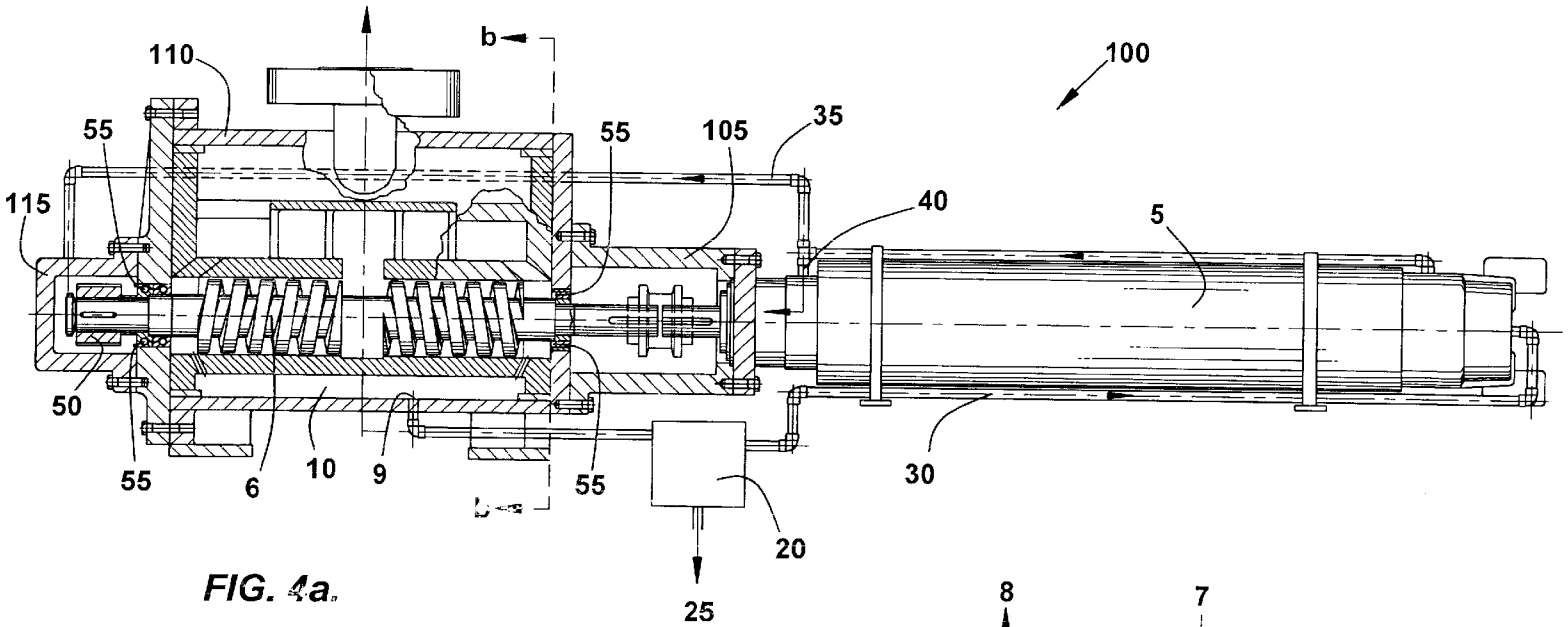
Figure 4B:
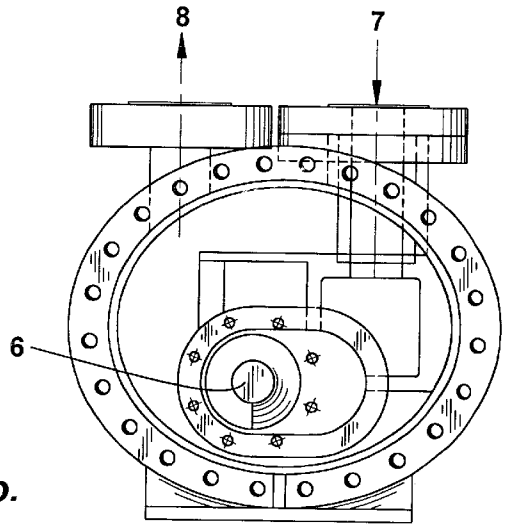

Recognizing that the mechanical seals are the weak point in the pump design, an alternate design approach is possible to eliminate these seals. With advanced materials available, the internal bearing 55 and timing gear 50 configuration shown in FIGS. 4*a* and 4*b* becomes viable. This figure shows an MP1-150 multiphase screw pump 100 with intermeshed screws 6 timed by product-lubricated outboard-mounted timing gears 50, in a timing housing 115, and rotatably supported in product-lubricated thrust bearings 55. The use of abrasion and corrosion resistant materials or coatings such as ceramics or metal carbides such as tungsten carbide will allow product lubrication of these components. The pump body 110 will be the same configuration as described above with the integral liquid separation chamber, or discharge fluid reservoir 10. Liquid from this chamber will pass through a take-off port 9 to be further purified with cyclone separators 20, to separate solid contaminants from the liquid, and then directed to the bearings 55 in the drive housing 105 and the timing gears 50 and bearings 55 in the timing housing 115 to provide adequate lubrication for these components.

Pumped fluid is extracted through the fluid take-off 9 from the discharge fluid reservoir 10, upstream of the pump discharge 8, and passed through cyclone separators within the contaminant separation unit 20, first to separate the liquid from the gases, then to separate the liquid from suspended grit and other solids. From there, a portion is passed through the timing gears 50 to cool and lubricate the gears and then into the screw shaft bearings 55 to cool and lubricate them. From the bearings, the fluid returns to the pump intake 7. Another portion of the fluid is passed through a conduit 30 to the canned motor 5, to cool the motor, and is then returned to the pump intake 7. It may be preferable, in some cases, to pass the fluid sequentially (in series) through conduit 30 for the motor 5, then to divide it between conduit 40, for the bearings 55 in the drive housing 105, and conduit 35, for the timing gears 50 and bearings 55 in the timing housing 115. In all cases, contaminants removed in the separation unit 20 are returned to the pump suction passage 7 via conduit 25.

The outboard-mounted thrust bearings 55 are equipped with trapped axial faces to provide thrust control in either direction. While the hydraulic loading of the screw pump is totally balanced in the axial direction, accurate axial positioning of the shafts in relation to the timing gears is important to maintain the screw "timing" and ensure that the screws do not contact each other. The timing gears 115 and thrust bearings 55 are located at the outboard ends of the pump to facilitate design and assembly with the product-lubricated bearings 55.

In this case, liquid product would cool and lubricate the motor 5. This same liquid, separated from the multiphase product, is circulated through the timing housing 115 and drive housing 105 to lubricate and cool the timing gears 50 and the bearings 55. Temperature sensors and shutdown controls will be used to shut down the pump and motor in case the supply of liquid is not sufficient to lubricate the bearings 55, timing gears 50 and motor 5.

This design provides significant advantages by totally eliminating mechanical seals. This sealless pump requires some development in the areas of product-lubricated timing gears and bearings but there are good success examples with new materials, suitable for these services. The potential benefits of the sealless pump in this environment make this development viable.

Having described the invention, we claim:

1. A pump, including a motor and a pump housing, for pumping mixed gas and liquid, said pump comprising:

two intermeshed screw members for providing progressive cavities for transporting mixed fluids, within a pumping cavity, from a suction passage to a discharge reservoir of said pump housing; and means for providing cooling and lubrication to said motor and to bearings and timing gears of the screw members.

2. The pump of claim 1, wherein the means for providing cooling and lubrication to said motor and to bearings and timing gears of the screw members comprises a discharge fluid take-off port for diverting a portion of pumped fluid from said discharge reservoir and directing said pumped fluid through said motor and through said bearings and timing gears of said screw members to provide cooling and lubrication to said motor, said bearings and said timing gears.

3. A multiphase screw pump-and-motor package comprising:

a pump body, including a housing with suction and discharge passages, a pumping chamber, and a discharge fluid reservoir between said discharge passage and said pumping chamber;

at least two intermeshed screw members supported in bearings and disposed within the pumping chamber for pumping fluid between said suction and discharge passages;

an electrical motor drivably connected to said screw members;

means for timing rotation of said screw members to prevent interference; and means for using pumped product to provide cooling and lubricating fluid to said motor, said bearings, and said timing means.

4. The pump package of claim 3, wherein the means for timing rotation of said screw members comprises a timing gear on each screw, said timing gears being intermeshed.

5. The pump package of claim 3, wherein the means for using pumped product to provide cooling and lubricating fluid to said motor, said bearings, and said timing means comprises a discharge fluid take-off port in said discharge fluid reservoir, said port connecting with a solid-contaminant/fluid separation unit, for separating contaminants and returning them to the suction passage of the pump, remaining fluid being directed through said motor, said bearings, and said timing means to cool and lubricate the same and then being returned to said suction passage.

6. The pump package of claim 5, wherein said remaining fluid is apportioned by separate conduits between said motor, said bearings, and said timing means.

7. The pump package of claim 5, wherein said remaining fluid is directed by a single path, in any order, sequentially to the motor, the bearings, and the timing means.

8. The pump package of claim 5, wherein a first portion of said remaining fluid is directed through a first conduit to said motor, and a second portion of said remaining fluid is directed through a second conduit sequentially, in any order, to said bearings and said timing means.

9. The pump package of claim 3, wherein the bearings supporting said screws and said timing means are fabricated from ceramics, carbides, or other abrasion and corrosion resistant materials amenable to lubrication by pumped fluid.

* * * * *